US009302313B2

(12) United States Patent
Lin

(10) Patent No.: US 9,302,313 B2
(45) Date of Patent: Apr. 5, 2016

(54) STRUCTURE OF A TUBE EXPANDER

(71) Applicant: Chen-Tzu Lin, Taichung (TW)

(72) Inventor: Chen-Tzu Lin, Taichung (TW)

( * ) Notice: Subject to any disclaimer, the term of this patent is extended or adjusted under 35 U.S.C. 154(b) by 210 days.

(21) Appl. No.: 14/273,665

(22) Filed: May 9, 2014

(65) Prior Publication Data

US 2015/0321237 A1 Nov. 12, 2015

(51) Int. Cl.

| | |
|---|---|
| ***B21D 41/02*** | (2006.01) |
| ***B21D 39/08*** | (2006.01) |
| ***B21D 39/10*** | (2006.01) |
| *B21D 19/00* | (2006.01) |

(52) U.S. Cl.

CPC ..... *B21D 41/021* (2013.01); *B21D 39/08* (2013.01); *B21D 39/10* (2013.01); *B21D 41/023* (2013.01); *B21D 19/00* (2013.01)

(58) Field of Classification Search

CPC ..... B21D 19/00; B21D 39/18; B21D 39/10; B21D 39/12; B21D 39/08; B21D 41/023; B21D 41/021; B21D 19/046; B21D 41/02

See application file for complete search history.

(56) References Cited

U.S. PATENT DOCUMENTS

| | | | | | |
|---|---|---|---|---|---|
| 3,050,103 | A * | 8/1962 | Janik | B21D 41/023 | 72/117 |
| 3,117,617 | A * | 1/1964 | Meese | B21D 41/023 | 72/116 |
| 3,195,337 | A * | 7/1965 | Janik | B21D 41/021 | 72/115 |
| 5,090,226 | A * | 2/1992 | Takeoka | B21D 41/023 | 408/132 |
| 2006/0117827 | A1 * | 6/2006 | Kao | B21D 41/021 | 72/117 |
| 2006/0243014 | A1 * | 11/2006 | Kao | B21D 41/023 | 72/117 |
| 2011/0192207 | A1 * | 8/2011 | Huang | B21D 41/021 | 72/120 |
| 2012/0240652 | A1 * | 9/2012 | Houle | B21D 41/021 | 72/316 |

* cited by examiner

*Primary Examiner* — Alexander P Taousakis
*Assistant Examiner* — Mohammad I Yusuf
(74) *Attorney, Agent, or Firm* — Rosenberg, Klein & Lee

(57) ABSTRACT

The structure of a tube expander has a ring and a bearing in the body thereof. An axle goes through the body. A driving head is connected to the axle on the body. The bottom of the axle has a guiding pin and a tapered head. The driving head has an external thread so that it can be rotated into the internal thread of the ring or rotated in the opposite direction out of the internal thread. A compressible elastic element is disposed inside the body and mounted on the axle. The top end of the compressible elastic element urges against the bottom of the ring. The bottom of the compressible elastic element pushes the guiding pin downward so that the external thread becomes idle after being completely rotated out of the internal thread.

4 Claims, 7 Drawing Sheets

STRUCTURE OF A TUBE EXPANDER

BACKGROUND OF THE INVENTION

1. Field of Invention

The invention relates to a tube expander and, in particular, to a tool that can expand a tube.

2. Related Art

The structure of a conventional tube expander is shown in FIG. 7. An axle 92 goes through the body 91 that is installed with a driving head 93. The lower part 911 of the body 91 has a guiding groove 912 for a pinch block 94 to enter. The body 91 has a through hole 913 going upward through the body 91 and downward to the guiding groove 912. At the top end of the through hole 913, the body 91 has an internal thread 914. The bottom end of the through hole 913 is provided with a bearing 95. The axle 92 inside the body 91 has a tapered head 921. The driving head 93 has an external thread 931 to engage the internal thread 914. As the driving head 93 rotates, the external thread 931 rotates with respect to the internal thread 914 so that the axle 92 displaces as it rotates. As the tapered head 921 deviates from the center, the tube 96 pinched by the pinch block 94 is expanded.

According to the above-mentioned structure of conventional tube expander, as the external thread 931 of the driving head 93 rotates into the internal thread 914 to the end, the continuing rotation of the tapered head 921 will continuously impose a pressure on the tube 96. In this case, the tube 96 will be deformed due to improper pressure. Therefore, a torque setting device is provided on the driving head 93 in the conventional tube expander. In this case, as the external thread 931 of the driving head 93 rotates into the internal thread 914 to the end, no further pressure is imposed on the tube 96 by the tapered head 921 even if the driving head 93 continues to rotate. This ensures that the tube 96 is not deformed by improper pressure.

Nonetheless, there is often another problem in practice. After the tube expansion is done, one has to reverse the driving head 93 for the external thread 931 to back out of the internal thread 914. Suppose the driving head 93 is driven by a hand tool with a larger torque, such as a motor-powered or air-powered screwdriver. If the driving head 93 is rotated out of the internal thread 914 to the limit without stopping in time, the body 91 will also rotate under the driving force of the driving head 93. If tthe user holds the body 91 by hand, his or her hand is likely to be twisted and hurt. If the body 91 is fixed by a vise, the hand tool may be over-worn by the twist and thus have a shorter lifetime.

SUMMARY OF THE INVENTION

In view of the foregoing, an objective of the invention is to provide a tube expander structure that does not sprain user's hand and prevent early worn-out of hand tools.

To achieve the above-mentioned objective, the invention includes:

a body with a trunk part, a neck part at the top end of the trunk part, the trunk part having a guiding groove for a pinch block that holds a tube, and a through hole inside the trunk part with the top end thereof going out of the neck part and the bottom end thereof connecting to the guiding groove;

a ring fixed inside the neck part in the through hole and being hollow with an internal thread;

a bearing fixed to the bottom end of the through hole and adjacent to the guiding groove;

a driving head having an external thread to engage the internal thread of the ring as the driving head rotates forward and to leave the internal thread as the driving head rotates in reverse;

an axle inside the body with the top end thereof going out of the neck part and connecting to the driving head and the bottom end thereof having a guiding pin positioned in the bearing, and having a tapered head disposed under the guiding pin and off the center; and a compressible elastic element disposed inside the trunk part and mounted on the axle, with the top end thereof urging against the bottom rim of the ring and the bottom end thereof pushing the guiding pin downward.

BRIEF DESCRIPTION OF THE DRAWINGS

These and other features, aspects and advantages of the invention will become apparent by reference to the following description and accompanying drawings which are given by way, of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Please refer to FIGS. 1 to 6 for an embodiment of the invention. This embodiment is provided for the purpose of illustration and should not be used to restrict the scope of the invention.

Figure 1:
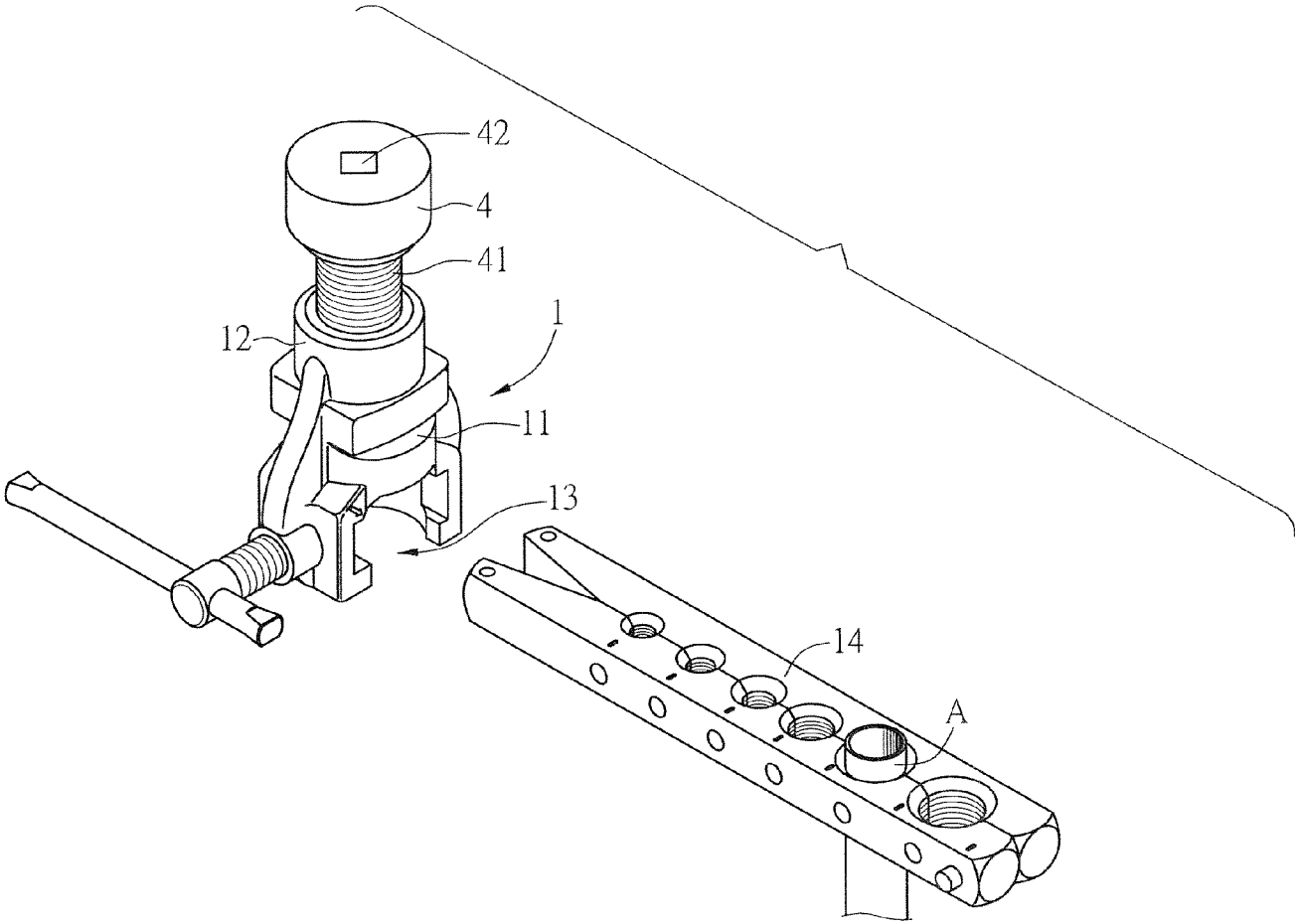
FIG. 1 is a three-dimensional view of the invention.
Figure 2:
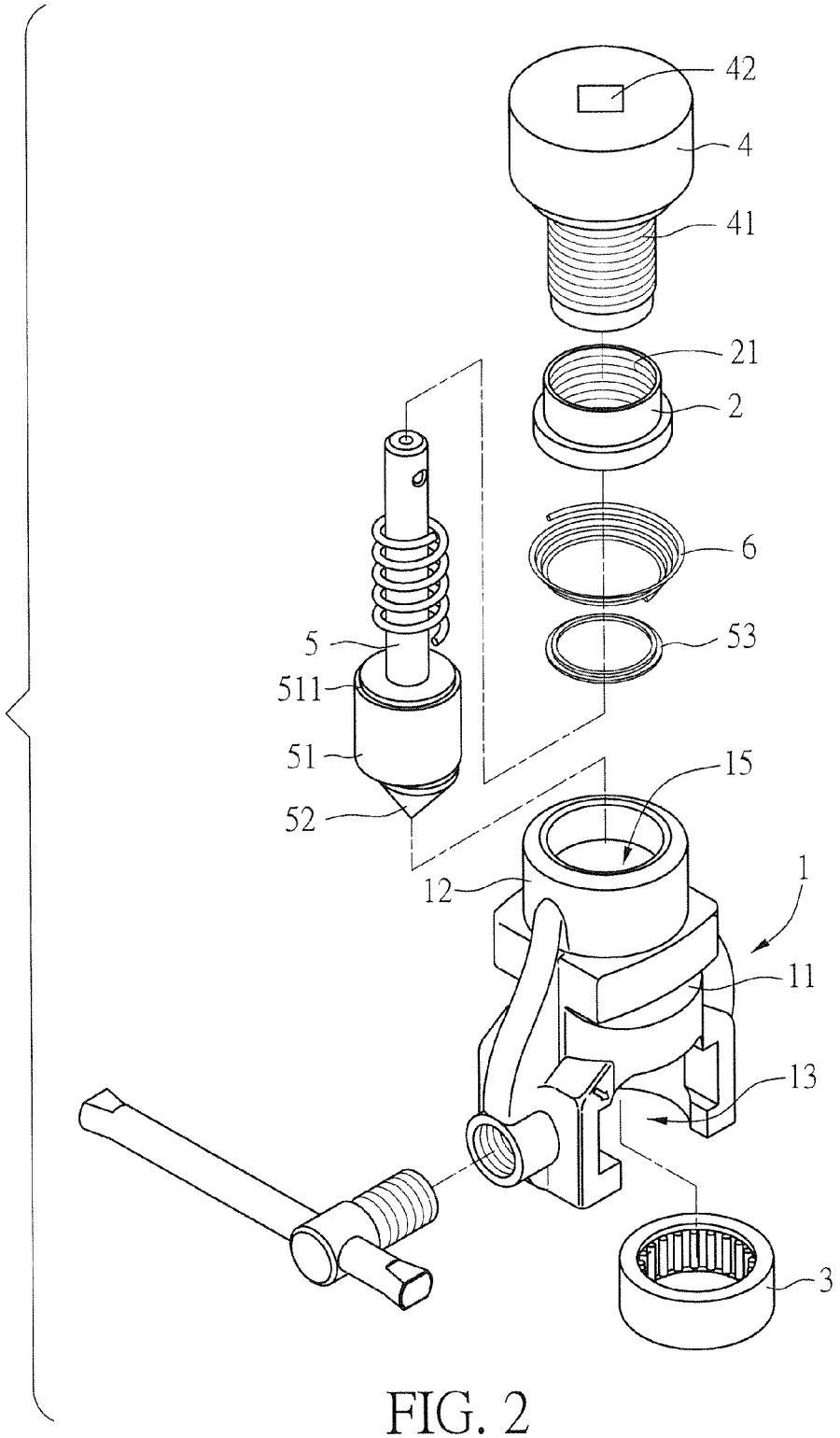
FIG. 2 is an exploded view of the invention.

The structure of the disclosed tube expander is shown in FIGS. 1 and 2 to contain a body 1, a ring 2, a bearing 3, a driving head 4, an axle 5, and a compressible elastic element 6.

Figure 3:
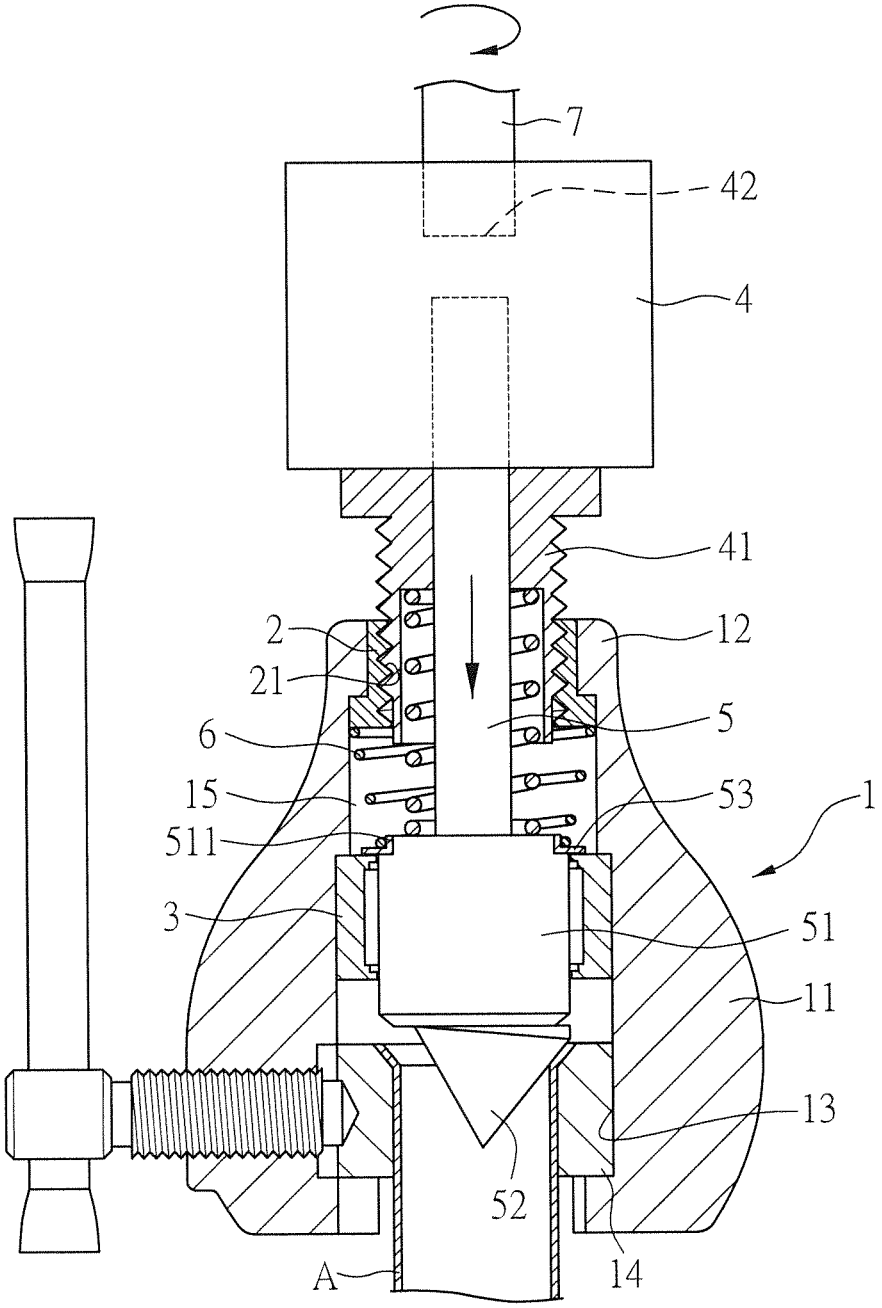
FIG. 3 is a schematic cross-sectional view of the invention in use.

As shown in FIGS. 2 and 3, the body 1 has a trunk part 11 and a neck part 12 at the top end of the trunk part 11. The trunk part 11 has a guiding groove 13 for the insertion of a pinch block 14 for holding a tube A. A through hole 15 goes from the inside of the trunk part 11 out of the neck part 12. The bottom end of the through hole 15 connects to the guiding groove 13.

As shown in FIG. 3, the ring 2 is fixed in the neck part 12 inside the through hole 15. The ring 2 is hollow and has an internal thread 21. The bearing 3 is fixed to the bottom end of the through hole 15 and adjacent to the guiding groove 13. As shown in FIGS. 2 and 3, the driving head 4 has an external thread 41 to engage the internal thread 21 as the driving head 4 rotates forward. The external thread 41 can be completely rotated out of the internal thread as the driving head 4 rotates in reverse. In this embodiment, the driving head 4 has a concave part 42 for the insertion of a screwdriver head of some hand tool, such as a motor-powered or air-powered screwdriver, thereby driven by the hand tool. The forward rotation referred herein is not a clockwise rotation, and the reverse rotation is not a counterclockwise rotation. The forward and reverse rotations referred herein are simply rotations in opposite directions. If one is a clockwise rotation, then the other is a counterclockwise rotation, and vice versa.

As shown in FIGS. 2 and 3, the axle 5 is disposed inside the body 1. The top end thereof goes out of the neck part 12 and connects to the driving head 4. The bottom end thereof has a guiding pin 51 positioned in the bearing 3 and a tapered head 52 under the guiding pin 51 and off the center.

As shown in FIGS. 2 and 3, the compressible elastic element 6 is disposed inside the trunk part 11 and mounted on the axle 5. The top end of the compressible elastic element 6 urges against the bottom rim of the ring 2. The bottom end of the compressible elastic element 6 pushes the guiding pin 51 downward.

As shown in FIGS. 2 and 3, the compressible elastic element 6 in this embodiment is a tapered spiral spring. Moreover, the top end of the guiding pin 51 has a pad 53 whose outer diameter is larger than the guiding pin 51. More explicitly, the top end of the guiding pin 51 in this embodiment has an annular concave part 511 with a shrinking outer diameter. The pad 53 and the guiding pin 51 are coaxially positioned to the annular concave part 511. The bottom end of the compressible elastic element 6 is disposed on the pad 53 to push the guiding pin 51.

As shown in FIG. 3, as one operates the tube expander, the tube A is first fixed by the pinch block 14. The pinch block 14 is then inserted into the guiding groove 13 of the trunk part 11. The tube A is aligned with the tapered head 52. Afterwards, one inserts the screwdriver head 7 of a hand tool (e.g., motor-powered or air-powered screwdriver) into the concave part 42 of the driving head 4. The user can then operate the hand tool so that the screwdriver head 7 drives the driving head 4 to rotate, so that the tapered head 52 expands the tube A.

Figure 4:
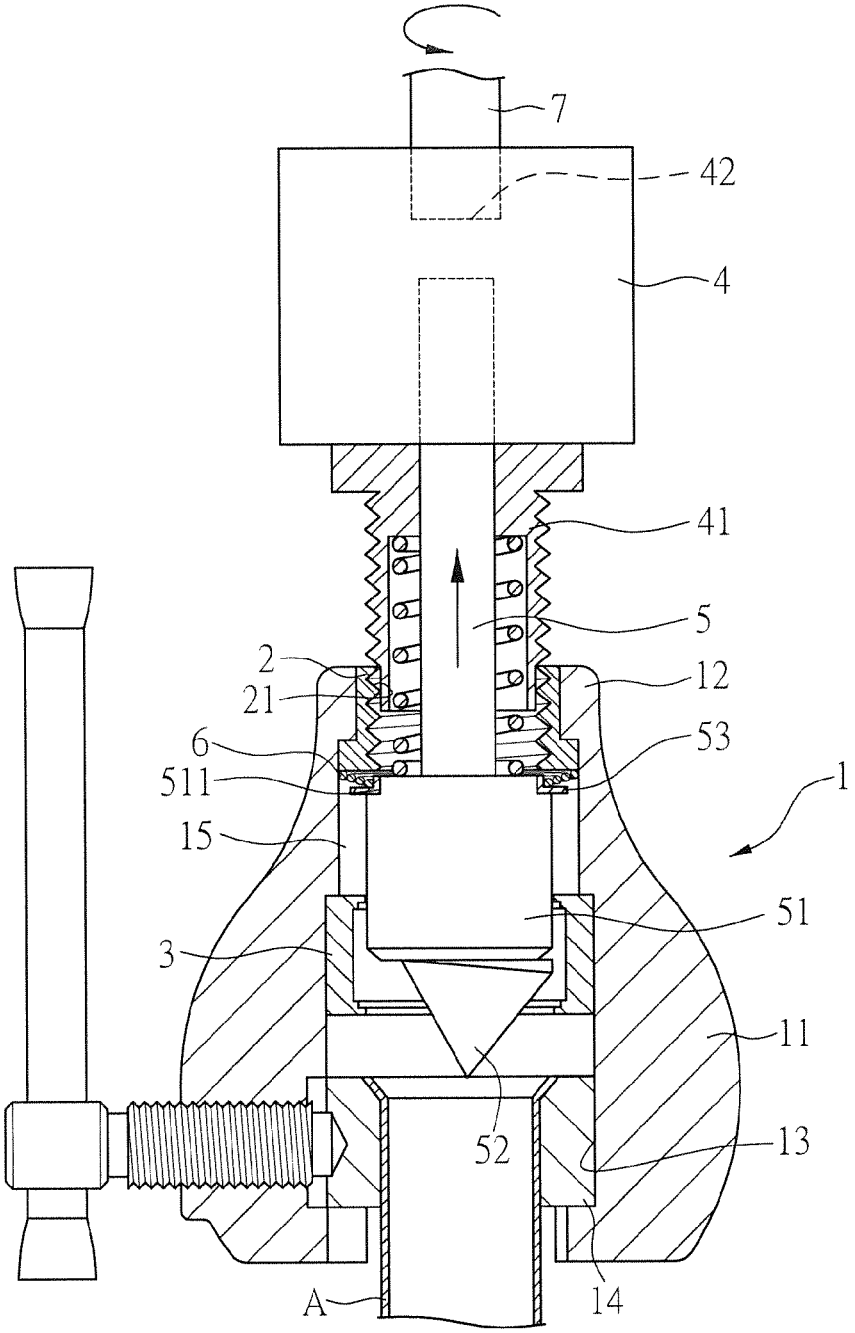
FIG. 4 is a schematic cross-sectional view showing that the driving head is rotated in reverse until the external thread is completely backed out of the internal thread.
Figure 5:
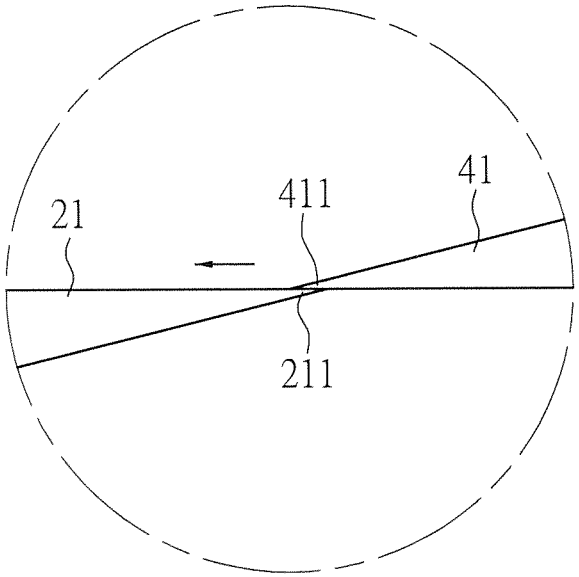
FIG. 5 is a locally enlarged view showing that the tooth of the external thread temporarily touches against the tooth of the internal thread.
Figure 6:
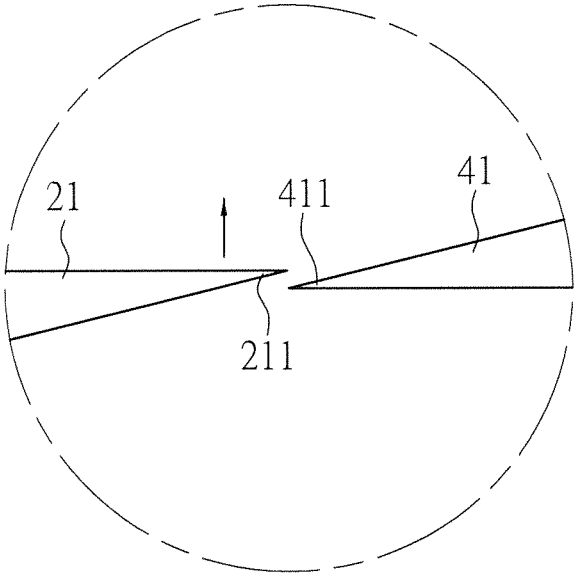
FIG. 6 is a locally enlarged view showing that the tooth of the external thread leaves the tooth of the internal thread.
Figure 7:
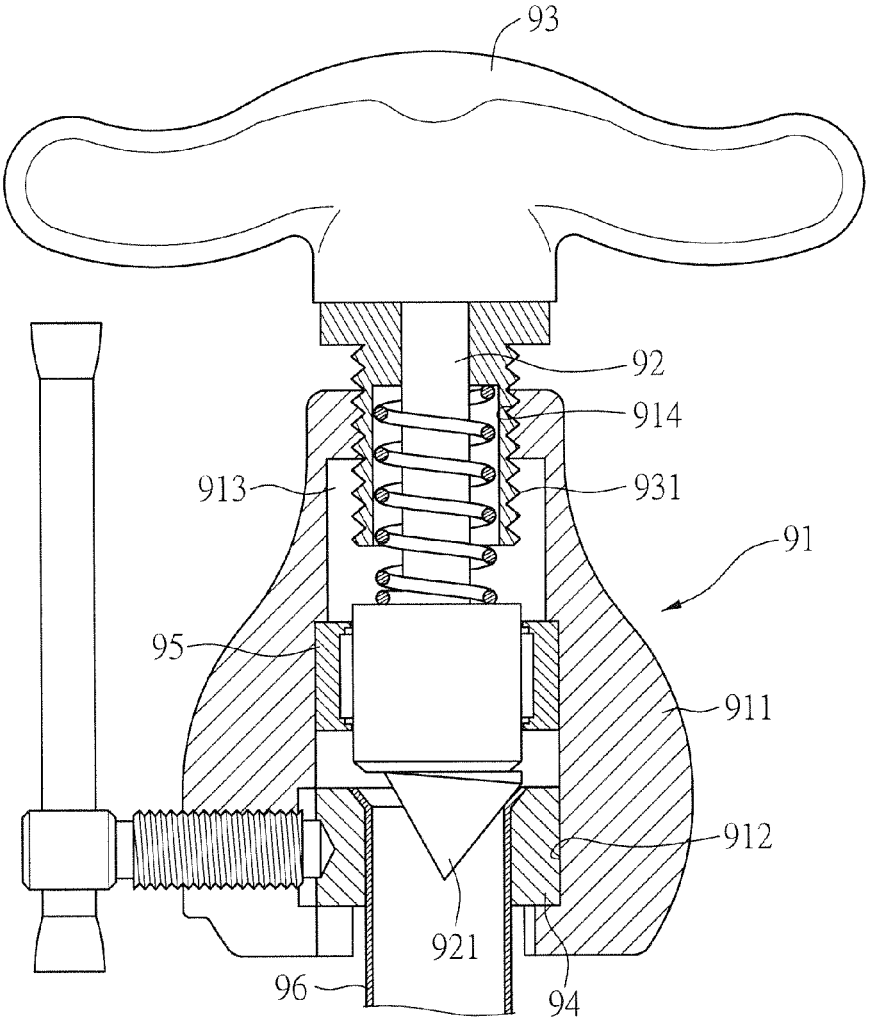
FIG. 7 PRIOR ART
FIG. 7 is a schematic cross-sectional view of a conventional tube expander.

After the tube A is expanded by the tapered head 52, the hand tool is set to rotate in reverse. The external thread 41 of the driving head 4 is then driven by the screwdriver head 7 to rotate out of the internal thread 21 until it is completely out of the internal tread, as shown in FIG. 4. In this case, the compressible elastic element 6 pushes the guiding pin 51 downward. Through the connection of the axle 5, the external thread 41 of the driving head 4 urges downward against the internal thread 21 of the ring 2. As shown in FIG. 5, if one enlarges the connection between the external thread 41 and the internal thread 21, one sees that the tooth of the external thread 41 temporarily rests on the tooth 211 of the internal thread 21. If the user further rotates the driving head 4 in reverse, the tooth 411 departs from the block of the tooth 211, as shown in FIG. 6. The action of the compressible elastic element 6 pushes the tooth 411 toward the internal thread 21 to the place ready for rotating into the internal thread 21. Therefore, if the driving head 4 continues to rotate in reverse, the external thread 41 idles at the place ready for rotating into the internal thread 21. As soon as the user drives the driving head 4 forward, the external thread 41 is immediately rotated into the internal thread for tube expansion.

From the above description, one sees that an advantage of the invention is the following. When the driving head 4 is driven by the screwdriver head 7 of a hand tool to rotate in reverse, the external thread 41 rotates out of the internal thread 21 until it is completely backed out of the internal tread 21. Even if the screwdriver head 7 is further rotated by the hand tool so that the driving head 4 continues to rotate, the external thread 41 idles at the place ready to rotate into the internal thread 21. This prevents the torque in the prior art when the driving head rotates out of the internal thread to the limit. This ensures that the user's hand is not sprained and that the hand tool is not over-worn.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A structure for a tube expander, comprising:

a body with a trunk part, a neck part at the top end of the trunk part, the trunk part having a guiding groove for a pinch block that holds a tube, and a through hole inside the trunk part with the top end thereof going out of the neck part and the bottom end thereof connecting to the guiding groove;

a ring fixed inside the neck part in the through hole and being hollow with an internal thread;

a bearing fixed to the bottom end of the through hole and adjacent to the guiding groove;

a driving head having an external thread to engage the internal thread of the ring as the driving head rotates forward and to leave the internal thread as the driving head rotates in reverse;

an axle inside the body with the top end thereof going out of the neck part and connecting to the driving head and the bottom end thereof having a guiding pin positioned in the bearing, and having a tapered head disposed under the guiding pin and off the center; and a compressible elastic element disposed inside the trunk part and mounted on the axle, with the top end thereof urging against the bottom rim of the ring and the bottom end thereof pushing the guiding pin downward.

2. The structure for a tube expander as in claim 1, wherein the compressible elastic element is a tapered spiral spring.

3. The structure for a tube expander as in claim 1, wherein the top end of the guiding pin has a pad whose outer diameter larger than the guiding pin, and the bottom end of the compressible elastic element is disposed on the pad to push the guiding pin.

4. The structure for a tube expander as in claim 3, wherein the top end of the guiding pin has an annular concave part with a shrinking outer diameter, and the pad and the guiding pin are coaxially positioned to the annular concave part.

* * * * *